United States Patent [19]

Arlauskas

[11] Patent Number: 4,586,737

[45] Date of Patent: May 6, 1986

[54] VEHICLE BODY DOOR LOCK

[75] Inventor: Alfonsas Arlauskas, Sunny Hills, Fla.

[73] Assignee: General Motors Corporation, Detroit, Mich.

[21] Appl. No.: 643,170

[22] Filed: Aug. 22, 1984

[51] Int. Cl.[4] ..... E05C 3/26

[52] U.S. Cl. ..... 292/216; 292/207

[58] Field of Search ..... 292/207, 216, 106, DIG. 23, 292/DIG. 27, 279

[56] References Cited

U.S. PATENT DOCUMENTS

| | | | |
|---|---|---|---|
| 451,526 | 5/1891 | Sandberg | 292/216 |
| 3,848,411 | 11/1974 | Watermann et al. | 292/216 |
| 3,899,202 | 8/1975 | Pickles | 292/216 |
| 4,158,996 | 6/1979 | Marulic et al. | 292/207 X |
| 4,334,704 | 6/1982 | Yamada | 292/216 |
| 4,438,964 | 3/1984 | Peters | 292/216 |

FOREIGN PATENT DOCUMENTS

| | | | |
|---|---|---|---|
| 649314 | 1/1951 | United Kingdom | 292/216 |

*Primary Examiner*—Robert L. Wolfe
*Assistant Examiner*—Russell W. Illich
*Attorney, Agent, or Firm*—Herbert Furman

[57] ABSTRACT

A vehicle body door lock includes a fork type bolt and a sliding detent member which moves between detent and undetented positions with respect to the legs of the bolt. The detent is slidably mounted in a plastic housing located within a box type frame of the lock. A compression spring biases the detent to detented position, with the detent being located by engagement of a shoulder of a plastic cap thereon with a stop mounted on the housing. A release mechanism for the detent includes an intermittent member movable between locked and unlocked positions with respect to another shoulder of the plastic cap of the detent through inside and outside release members.

8 Claims, 8 Drawing Figures

VEHICLE BODY DOOR LOCK

This invention relates generally to vehicle body door locks and more particularly to vehicle body door locks of the detented fork bolt type.

Fork bolt type vehicle body door locks are well known. In such locks, the bolt is normally detented by a hook type detent which is pivoted to the lock frame and engageable under a bias with each of the legs of the bolt to retain the bolt in either partially latched position or fully latched position. The detent may be released by a linkage arrangement actuated from the inside and outside of the door through release levers and an intermittent link which is moved between coupled and uncoupled positions with respect to the detent by a locking lever controlled from both inside and outside of the door, such as by a garnish button or inside actuator and by a key cylinder.

This invention provides a fork bolt type vehicle body door lock of this general type. However, in the lock of this invention, the bolt is detented in either both partially latched and fully latched positions by an elongated detent member which moves linearly or is slidable between an extended detented position and a retracted undetented position with respect to the legs of the fork bolt. The detent is resiliently biased to its detented position in the path of rotative movement of the legs of the bolts. In the preferred embodiment of the invention, the lock includes a box type lock frame having an outer wall, spaced vertical side walls and top and bottom walls. A housing of plastic material fits within the frame and includes a throat receiving the head of the striker pin upon closing of the door and movement of the shank of the striker pin within the frame through openings in one side wall and the outer wall thereof. The bolt is pivoted to the frame and moves between an outer wall of the housing and the outer wall of the frame. The housing includes an integral vertical passage which slidably receives an elongated detent which is biased toward an extended detented position in the path of movement of the legs of the bolt by a compression spring seated between the upper wall of the frame and the upper end of the detent. A cap of plastic material is secured to the upper portion of the detent and includes a passage for the detent spring and a pair of shoulders extending normal to each other. One of the shoulders cooperates with an abutment of the housing to provide a stop locating the detent in an extended detented position under the bias of the detent spring. The other of the shoulders provides a connection between the detent and an intermittent member when the intermittent member is in coupled position. The other side wall of the frame extends at a slight angle to the outer wall thereof and is provided with an indentation which abuts and backs up the detent receiving passage of the housing. The open inner wall of the frame is closed by a back plate which is secured to the side walls of the frame by tabs received in openings therein. One of the tabs is located at the indentation so that the back plate ties the side walls to each other whereby the one side wall reinforces the other side wall under pullout loads.

The primary feature of this invention is that it provides an improved vehicle body fork bolt type lock wherein the bolt is held in one or more latched positions by a linearly movable or slidable elongated detent member. Another feature is that the detent member blocks movement of the bolt to unlatched position by engagement, in detented position, with the leading edge of each leg of the bolt. A further feature is that the detent member is slidably mounted in a housing mounted to the lock frame. Yet another feature is that the detent member is resiliently biased to detented position with respect to the legs of the bolt and is located in detented position by engagement of a shoulder thereof with a shoulder of the housing. Yet a further feature is that the shoulder is part of a cap of plastic material secured to the detent member and also seating the spring biasing the detent member to detented position. Still another feature is that the cap includes an additional shoulder providing a cooperative connection between the detent member and an intermittent member when the intermittent member is in the coupled position. Still a further feature is that the housing is of plastic material and is located within a box type lock frame having a side wall which backs up a passage in the housing slidably mounting the detent member. Yet another feature is that the one side wall is tied by a back plate to an opposite side wall to increase the pullout resistance of the one side wall.

These and other features will be readily apparent from the following specification and drawings wherein.

Figure 1:
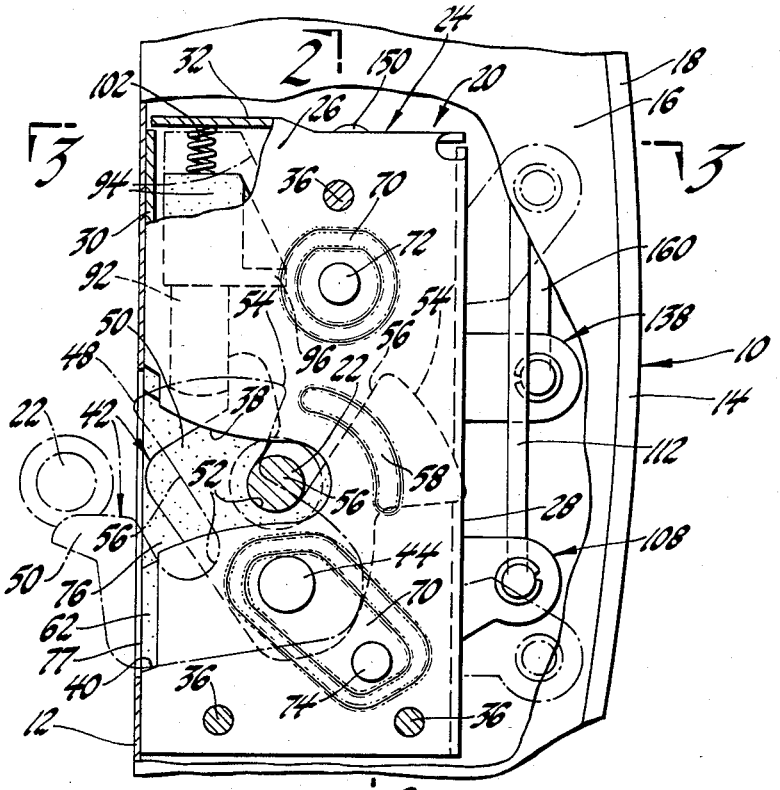
FIG. 1 is a partially broken away view of the lock pillar wall of a vehicle body door having a door lock accord to this invention mounted thereon.

Referring now particularly to FIG. 1 of the drawings, a vehicle body door designated generally 10 includes an inner panel 12 and an outer panel 14. The inner panel 12 includes a lateral extension which provides the lock pillar wall 16 of the door 10. The outboard edge of the wall 16 includes a lateral terminal flange which is hem flanged at 18 to the outer panel 12 of the door in a conventional manner. A vehicle body door lock 20 according to this invention is mounted on the lock pillar wall 16, as will be described, and engages a headed striker pin 22 mounted on an opposing lock pillar wall of the vehicle body to retain the door 10 in closed position. Disengagement of lock 20 from the striker pin, as shown in dash lines, releases the door for movement to open position.

Figure 3:
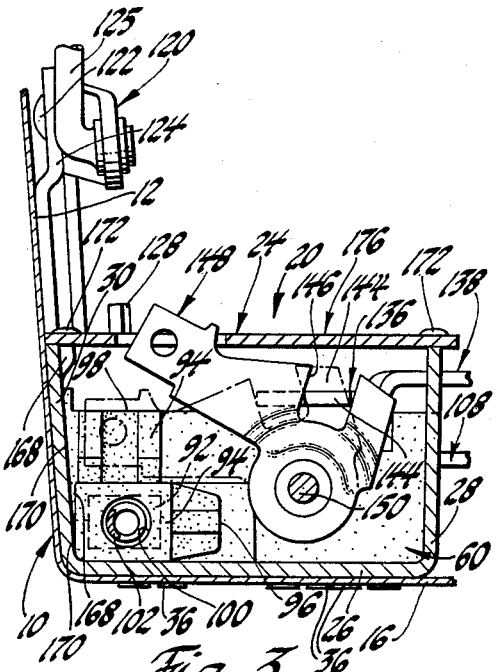
FIG. 3 is a sectional view taken generally along the plane indicated by line 3—3 of FIG. 1.
Figure 2:
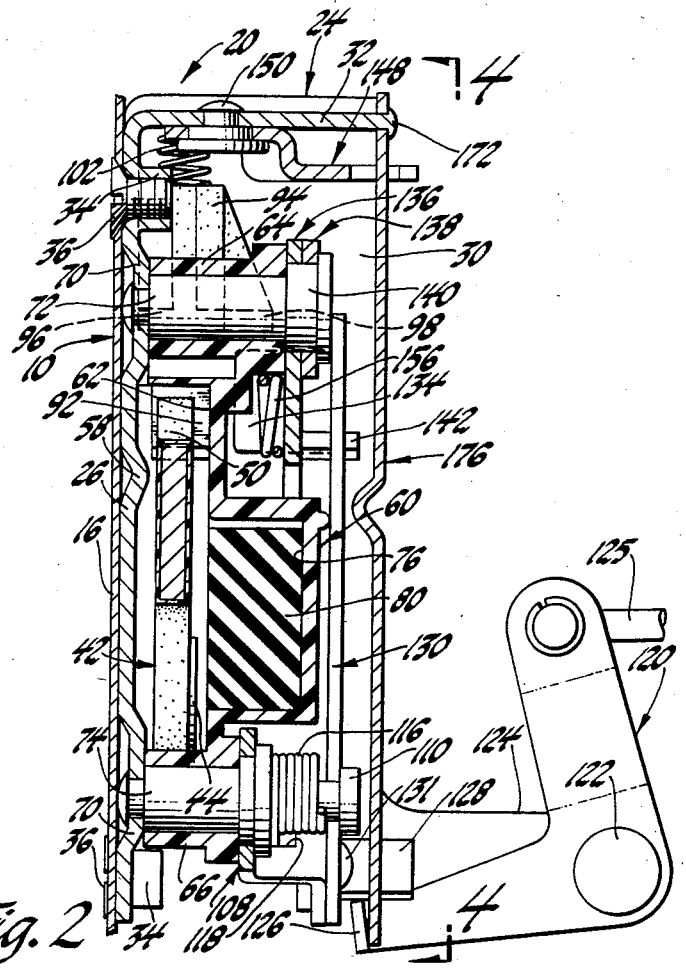
FIG. 2 is a sectional view taken generally along the plane indicated by line 2—2 of FIG. 1.

The door lock 20 includes a box type frame 24 having an outer wall 26, an outer side wall 28, an inner side wall 30 and an upper wall 32. The wall 26 abuts against the wall 16 of door 10 as shown in FIGS. 1, 2 and 3 and includes a series of extruded tapped embossments 34 which receive bolts 36 to secure the lock 20 to the wall 16. The walls 26 and 30 are provided with respective openings 38 and 40, FIG. 8, to provide for entry of the striker pin 22 into the frame 24. The wall 16 and the inner panel 12 of the door are provided with openings corresponding to the openings 38 and 40.

Figure 8:
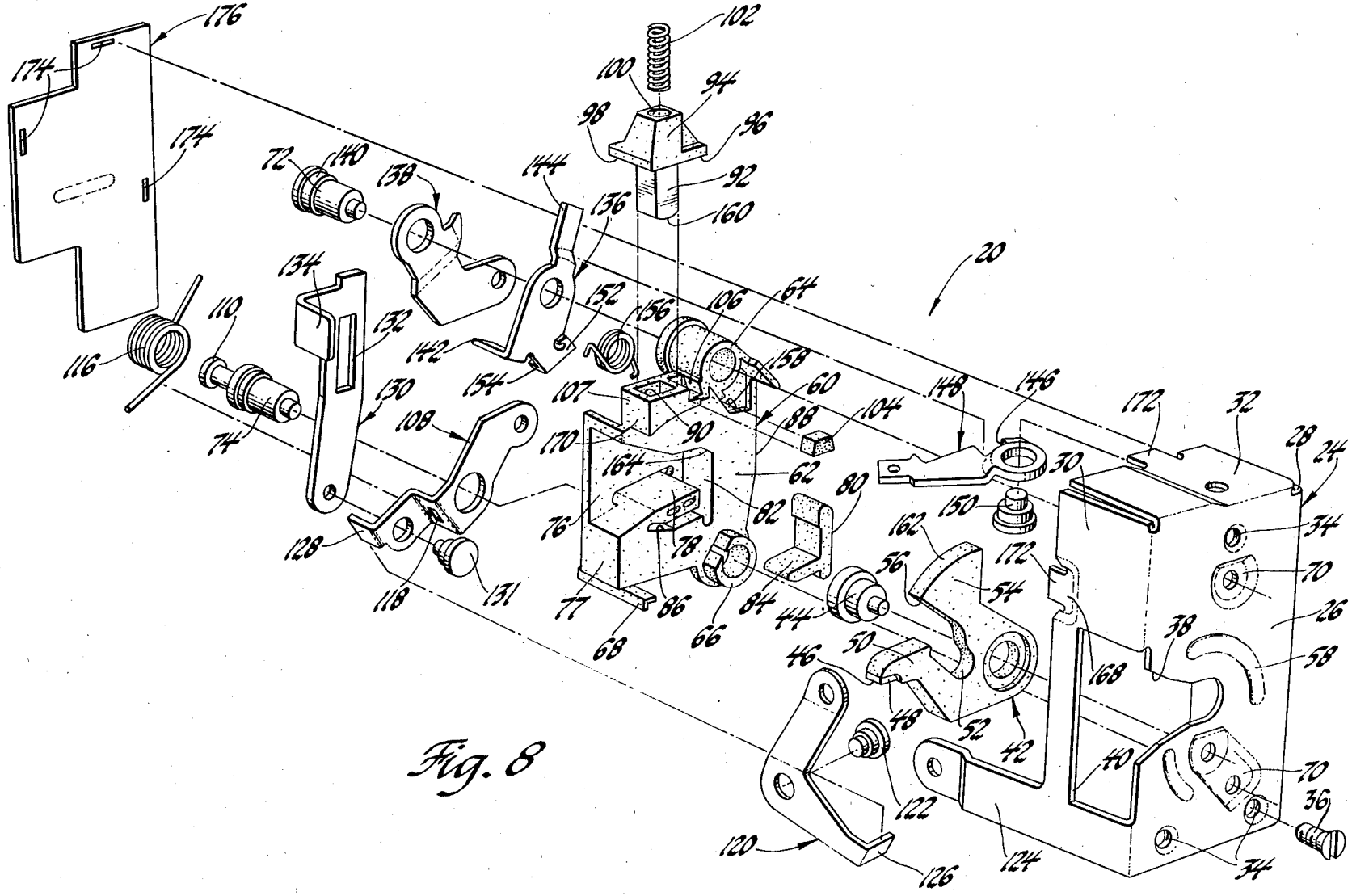
FIG. 8 is an exploded perspective view of the components of the lock.

A fork type bolt 42 is pivoted to the wall 26 by a headed stud 44, FIG. 8. The bolt 42 is coated with plastic material except for the edge 46 and portion 48 of the leg 50 thereof. The throat 52 is provided by leg 50 and leg 54 and includes a detent engageable edge 56. The throat 52 of the bolt receives the shank of the striker pin 22. The wall 26 of the frame includes an integral indented arcuate rib 58 to guide rotational movement of the bolt relative to this wall.

A housing 60, FIG. 8, of plastic material is located within the frame 24 and includes a wall 62 which is formed integral with a pair of tubular extensions 64 and 66 and a spacer 68. The outer ends of extensions 64 and 66 and spacer 68 respectively abut against indented embossments 70 of wall 26 and wall 26, FIGS. 2 and 8. The extensions receive shouldered studs 72 and 74 to mount the housing 60 within the frame 24. The wall 62 is spaced from the inside of the wall 26 as shown in FIG. 2 so that the bolt 42 can rotate in the space between these walls. The housing 60 further includes an integral throat 76, FIG. 8, which opens through wall 62 and side wall 77 and receives the head of the apertured striker pin 22. The head of the striker pin engages an integral deflectable extension 78 on the lower wall of the throat and the upper wall of the throat to vertically position the door relative to the body pillar. A rubber bumper 80 fits against the inner wall 82 of the throat and has an integral tab 84 which is received within a slot 86 below the extension 78. The rubber bumper is engaged by the head of the striker pin 22. Tab 84 resiliently backs up extension 78. The side walls 77 and 88 of housing 60 respectively abut walls 30 and 28 of frame 24, FIGS. 4 and 6. The openings to the throat 76 through walls 62 and 77 open to openings 38 and 40 of frame 24.

Figure 7:
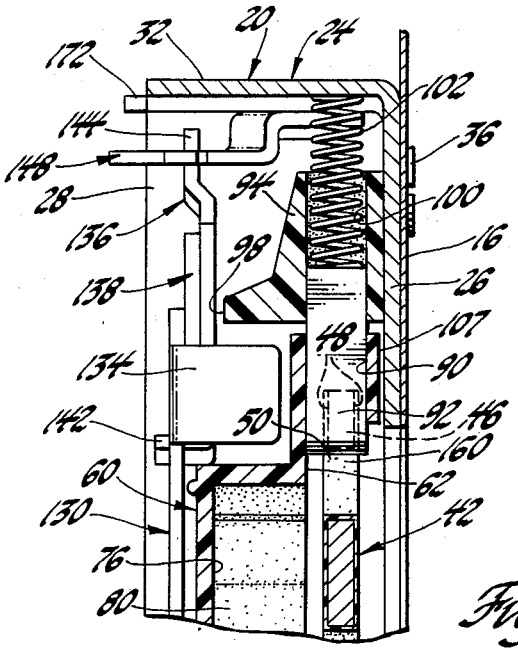
FIG. 7 is a sectional view taken generally along the plane indicated by line 7—7 of FIG. 4.

The housing 60 further includes an integral rectangular cross-section passage 90 which extends generally vertically and opens to the space between the wall 62 and the inside of the wall 26 within which the bolt 42 rotates. The inner wall of passage 90 is coplanar with wall 62. A generally rectangular detent member 92 is slidably received within passage 90 and includes a cap 94 of plastic material secured thereto. The cap includes integral lateral shoulders 96 and 98 which are rib reinforced and extend generally normal to each other, FIG. 3, and a generally circular bore 100 which extends through the cap 94 and receives a compression spring 102. The spring 102 seats between the wall 32 of the frame 24 and the upper end of the detent member 92 as shown in FIG. 7 to continually bias the detent member vertically downwardly to detented position, FIGS. 4 and 5. The detent member is located in detented position by the engagement of the shoulder 96 of the cap 94 with a rubber bumper 104 frictionally housed within a like shaped groove 106 of the housing 60 which opens upwardly and outwardly of wall 62 and is formed integrally with extension 64 and the box portion 107 of housing 60 which provides pasage 90, FIG. 8.

Figure 4:
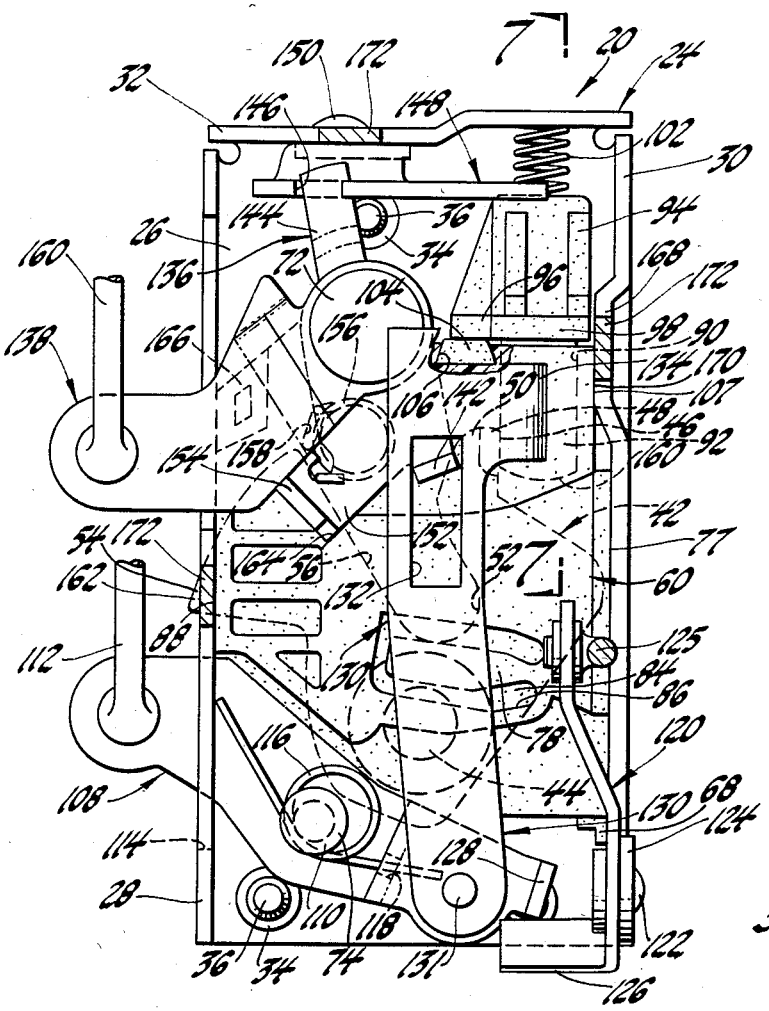
FIG. 4 is a view taken generally along the plane indicated by line 4—4 of FIG. 2 and showing the bolt in fully latched position and the intermittent member in coupled position.
Figure 5:
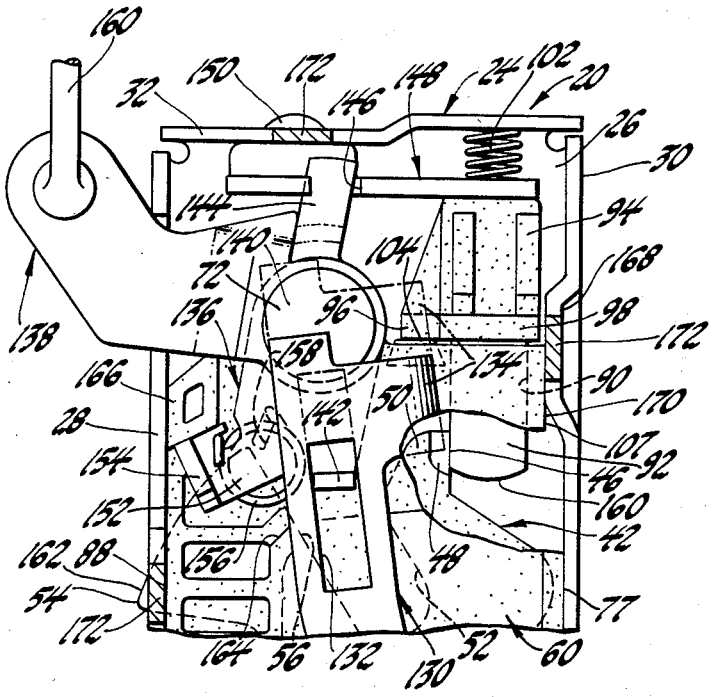
FIG. 5 is a partial view similar to FIG. 4 and showing the intermittent member in uncoupled position.

When the bolt 42 is in its fully latched position as shown in FIGS. 4 and 5, the detent member 92 engages the edge 46 of the leg 50 of the bolt to retain the bolt in this position. Alternatively, the detent member 92 can engage the edge 56 of the leg 54 to retain the bolt in an intermediate or partially latched position, not shown.

An outside release lever 108 is rotatably mounted on a shoulder of an extension 110 of the stud 74, FIG. 2. The release lever 108 has one leg thereof connected to a rod 112, FIGS. 4 and 6, which extends vertically upwardly for connection to the outside release operator of the door, not shown. The release lever extends outwardly of the wall 28 of frame 24 through a slot 114 thereof. A coil torsion spring 116 surrounds the extension 110 and has one leg thereof engaging the wall 28 and the other leg thereof extending through an opening 118, FIG. 8, in an offset of the lever 108 to bias the lever clockwise as viewed in FIGS. 4 and 6 and engage the one leg of the lever with the upper edge of the slot 114. An inside release lever 120 is pivoted at 122 to an extension leg 124 of wall 30 of frame 24. One leg of the lever 120 is connected to a rod 125 which extends forwardly of the door for connection to a suitable inside release operator. The other leg of the inside release lever 120 includes a lateral tab 126 which underlies a lateral tab 128 of the other leg of lever 108.

An intermittent link 130 is pivoted at 131 to the other leg of the outside release lever 108. The link 130 extends generally upwardly and includes a slot 132 and a lateral tab 134. Tab 134 underlies the shoulder 98 of the cap 94 of the detent member 92 when the intermittent link is in coupled position, FIGS. 4 and 6, and is located to one side of shoulder 98 in a bypass position when the link is in uncoupled position, FIG. 5. A locking lever 136 and a key cylinder lever 138 are pivoted to an extension 140 of stud 72, FIG. 2. The locking lever 136 includes a lateral tab 142 which is received within the slot 132 of the intermittent link 130. The locking lever further includes an offset leg 144 which is received within a slot 146 of an auxiliary locking lever 148 which is pivoted at 150 to the upper wall 32 of the frame 24. Another leg 152 of the locking lever includes a lateral tab 154 which underlies the key cylinder lever 138. Leg 152 is connected to one leg of an overcenter spring 156, the other leg of which is hooked in a slot 158 of the housing 60, FIG. 8. A rod 160 connects the key cylinder lever 138 to a conventional lock cylinder mounted on the outer panel 14 of the door 10 adjacent to the door handle or outside release operator.

The lever 148 is connected to an inside locking member which is mounted on the inner panel of the door 12 forwardly thereof and normally adjacent to the inside operator of the door.

When the intermittent link 130 is in coupled position as shown in FIG. 4, manual movement of the outside release operator to shift the rod 112 downwardly will rotate the lever 108 counterclockwise against the bias of spring 116. This shifts the intermittent link 130 upwardly and the engagement of tab 134 with the shoulder 98 moves the detent member 92 upwardly within passage 90, against the bias of spring 102, to undetented position, FIG. 6, to release the detent member 92 from engagement with the edge 46 of the leg 50 of bolt 42. This permits the door to be opened as the bolt rotates clockwise from its FIG. 4 fully latched position to its FIG. 6 unlatched position out of engagement with the shank of the striker 22. The bolt can also be released by manual movement of the inside operator to rotate the inside remote lever 120 about its pivot 122 and engage the tab 126 with the tab 128 to rotate the outside release lever 108 in the same manner as previously described.

When the outside operator or inside operator is manually released, the spring 116 returns the lever 108 and the lever 120, if rotated, to their positions shown in FIG. 4. The detent member 92 also returns to its position shown in FIG. 4 under the bias of spring 102. The lower curved end or edge 160 of the detent member 92 will engage the curved edge 162 of the leg 54 of the bolt 42. This position of the detent member is not shown. The bolt 42 is moved to its unlatched position by disengagement of the bolt throat 52 from the shank of the striker pin 22 and is frictionally retained in unlatched position.

Figure 6:
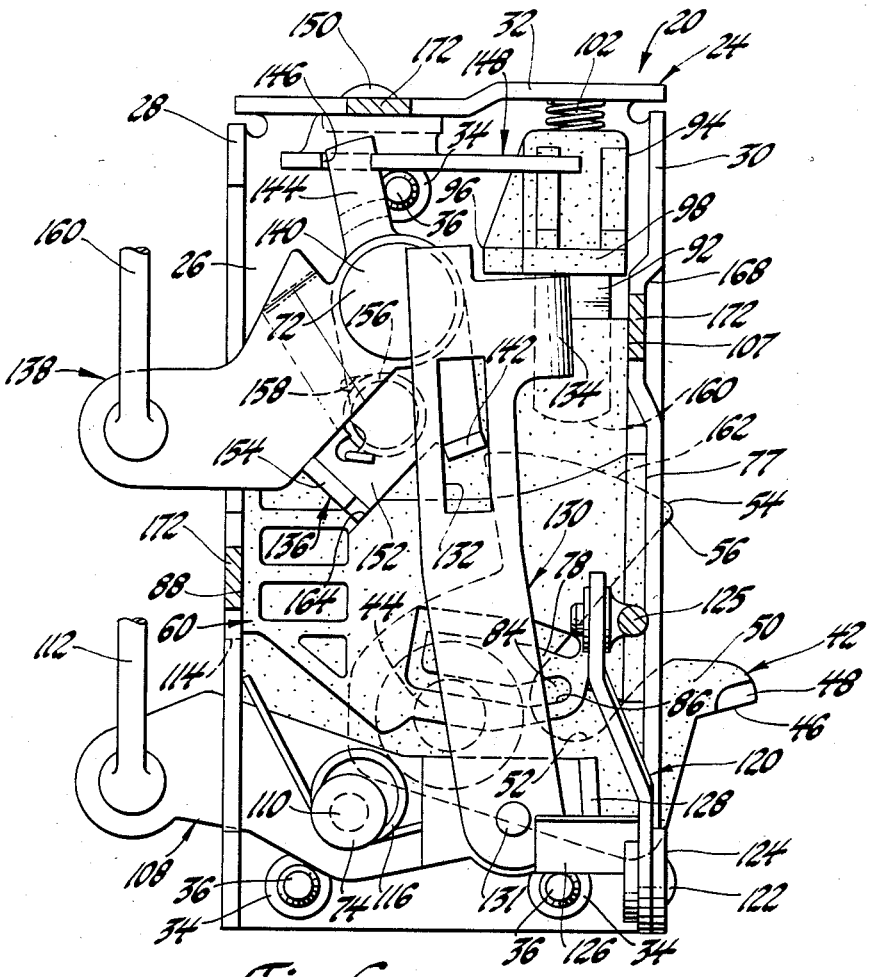
FIG. 6 is a view similar to FIG. 4 and showing the detent member being moved to released position by an inside remote lever.

When door 10 is thereafter closed, the engagement of the shank of the striker pin 22 with the edge 56 of leg 54 rotates the bolt 42 counterclockwise from its FIG. 6 position to its FIG. 4 position. The edge 160 of the detent member 92 will ride along the edge 162 of leg 54 and will engage either the edge 56 of this leg, to retain the bolt 42 in an intermediate or partially latched position, or the edge 46 of leg 50, to retain the bolt in a fully latched position, depending upon the extent of closing movement of door 10.

Should the inside locking member be operated to rotate the lever 148 about its pivot 150, counterclockwise as viewed in FIG. 3, the locking lever 136 will be rotated clockwise from its FIG. 4 position to its FIG. 5 position. This rotates the intermittent link 130 counterclockwise about pivot 131 to uncoupled position wherein the tab 134 is moved from underneath the shoulder 98 to a bypass position, FIG. 5. Thereafter any shifting movement of the intermittent link by operation of either the inside or outside operators will not release the detent member 92 since the tab 134 will merely bypass the shoulder 98, as shown in dash lines in FIG. 5. The locking lever 136 is located in its unlocked position as shown in FIG. 4 by engagement of the lower edge of leg 152 with the inner side of the upper corner 164 of throat 76, FIGS. 4 and 8, under the bias of spring 156. Lever 136 is located in its locked position as shown in FIG. 5 by engagement of the upper edge of leg 152 with an abutment 166 of the housing under the bias of spring 156. The locking lever 136 is movable to locked or unlocked positions by lever 148 and the inside locking member. The key cylinder lever 138 is coupled to the locking lever by engagement of the lower edge thereof with tab 154 of leg 152. The lever 148 can thus move the locking lever 136 and lever 138 between their FIG. 4 and FIG. 5 unlocked and locked positions respectively. However, the lever 138 can only move the levers 136 and 148 from their FIG. 5 position to their FIG. 4 position. If the locking lever is moved to locked position when the bolt 42 is unlatched, keyless locking will occur when the door 10 is closed.

As shown in FIG. 3, the wall 30 of the frame 24 extends at an angle approximately $3\frac{1}{2}°$ from normal to the wall 26. This permits the wall 30 to follow and abut the inner panel 12 of the door 10. The wall 30 includes an indentation 168, FIGS. 3, 4, 5 and 8, which abuts the outer side wall 170 of box portion 107 to back up this wall and detent member 92 under pullout loads. Wall 170 is coplanar with wall 77. Walls 28, 30 and 32 each include a tab or extension 172. These tabs are received through openings 174, FIG. 8, in a generally T-shaped back plate 176 which generally closes the rear opening of the box type frame 24. The tabs are headed over the back plate, FIG. 2. By locating a tab 172 adjacent the indentation 168 and tying this tab to the tab 172 on wall 28 through the back plate 176, the wall 28 directly reinforces the wall 30 against pull out loads imposed thereagainst by the wall 170 of the box portion 107 and detent member 92.

As can be seen from the foregoing description the lock of this invention is of very compact construction and the box type frame 24 together with the back plate 176 cooperatively house the operating components of the lock as well as resist pull out loads. Further, the sliding detent provides for smooth operation of the lock and particularly its movement between detent and undetented positions with respect to the legs of the fork bolt 42.

Thus this invention provides an improved vehicle body door lock.

The embodiment of the invention in which an exclusive property or privilege is claimed are defined as follows:

1. A closure latch, comprising in combination, a frame, a fork type bolt mounted on the frame for rotational movement between locked and unlocked positions and including a pair of legs defining a striker receiving throat, a housing mounted to the frame and including a linear passageway opening to the path of rotational movement of the legs of the bolt, an elongated detent member slidably mounted within the passageway of the housing for linear reciprocal movement between an extended detented position wherein one end thereof is located in the path of rotational movement of the legs of the bolt and a retracted undetented position wherein the one end thereof is out of such path of movement, said passageway having a wall thereof engaging a wall of said frame to back up the passageway wall against forces applied thereto by the detent member when in detented position, means on the other end of the detent member engageable with an end of the passageway to locate the detent member in detented position, resilient means seating between the frame and the other end of the detent member and biasing the detent member to detented position, an operating lever pivotally mounted on the frame, an elongated intermittent member having one end thereof pivoted to the operating lever and having the other end thereof provided with abutment means movable into and out of opposition to complementary abutment means on the other end of the detent member to selectively couple and uncouple the intermittent member and the detent member, and means for moving the intermittent member relative to the operating lever between coupled and uncoupled positions relative to the detent member.

2. A closure latch, comprising in combination, a frame, a fork type bolt mounted on the frame for rotational movement between locked and unlocked positions and including a pair of legs defining a striker receiving throat, a housing mounted to the frame and including a linear passageway opening to the path of rotational movement of the legs of the bolt, an elongated detent member slidably mounted within the passageway of the housing for linear reciprocal movement between an extended detented position in the path of rotational movement of the legs of the bolt and a retracted undetented position out of such path of movement, resilient means biasing the detent member to detented position, means locating the detent member in detented position under the bias of the resilient means, movable operating means including an intermittent member selectively movable (1) to a first position wherein movement of the operating means engages the intermittent member with the detent member to move the detent member to undetented position against the bias of the resilient means, and, (2) to a second position wherein the intermittent member bypasses the detent member upon movement of the operating means to permit the resilient means to maintain the detent member in detented position, and means for selectively moving the intermittent member to the first and second positions.

3. A closure latch, comprising in combination, a frame, a fork type bolt mounted on the frame for rotational movement between locked and unlocked positions and including a pair of legs defining a striker receiving throat, a housing mounted to the frame and including linear passageway means opening to the path of rotational movement of the legs of the bolt, an elongated detent member slidably mounted within the passageway means of the housing for linear reciprocal movement between an extended detented position in the path of rotational movement of the legs of the bolt and a retracted undetented position out of such path of movement, shoulder means on the detent member engageable with the passageway means adjacent one end thereof to locate the detent member in extended position, resilient means seating between the frame and detent member to bias the detent member to detented position, movable operating means including an intermittent member selectively movable (1) to a first position wherein movement of the operating means moves the intermittent member into engagement with the shoulder means of the detent member to move the detent member to undetented position against the bias of the resilient means, and, (2) to a second position wherein the intermittent member bypasses the shoulder means of the detent member upon movement of the operating means to permit the resilient means to maintain the detent member in detented position, and means for selectively moving the intermittent member to the first and second positions.

4. The combination recited in claim 2 wherein the means locating the detent member in detented position includes a first shoulder engageable with the housing adjacent one end of the passageway thereof, and the detent member includes a second shoulder adjacent the first shoulder for engagement by the intermittent member when the intermittent member is in the first position thereof and is moved with the operating means.

5. The combination recited in claim 2 wherein the frame includes an outer wall and side walls, the housing is of plastic material and is spaced from the outer wall to provide space for the bolt to swing between the housing and the outer wall of the frame, and the passageway of the housing is located adjacent to and backed up by one of the side walls of the frame.

6. The combination recited in claim 2 wherein the frame includes an outer wall, a side wall, and an upper wall, the housing is of plastic material and the passageway thereof is backed up by the side wall of the frame, and the resilient means seats between the upper wall of the frame and the detent member.

7. The combination recited in claim 2 wherein the means locating the detent member in detented position includes a plastic cap secured to one end of the detent member and having a first shoulder engageable with the housing adjacent one end of the passageway to locate the detent member in detented position, the cap further including a second shoulder engageable by the intermittent member when the intermittent member is in the first position for moving the detent member to undetented position.

8. The combination recited in claim 2 wherein the frame includes an outer wall and a pair of side walls, the housing passageway is located adjacent to and is backed up by one of the side walls, and the side walls are connected to each other by a back plate to reinforce each other against pull out loads applied against the one side wall by the detent member through the pasageway of the housing.

* * * * *